United States Patent [19]

Chapman et al.

[11] 3,955,079

[45] May 4, 1976

[54] MULTIPLE POSITION LAMP

[76] Inventors: Earle F. Chapman, Summer St., Marshfield Hills, Mass. 02050; Bernard J. Ruskin, 17 Sheldon Road, Marblehead, Mass. 01945

[22] Filed: Jan. 22, 1974

[21] Appl. No.: 435,451

[52] U.S. Cl. ..... 240/70; 240/81 BC

[51] Int. Cl.[2] ..... F21V 21/22

[58] Field of Search ..... 240/67, 68, 69, 70, 240/81 BC, 81 BS, 81 BD, 81 BE, 81 BF; 174/69, 135, 136

[56] References Cited

UNITED STATES PATENTS

| | | | |
|---|---|---|---|
| 1,682,342 | 8/1928 | Kraft | 240/81 BC |
| 1,914,480 | 6/1933 | Brosilow et al. | 240/81 BS |
| 1,946,128 | 2/1934 | Brosilow et al. | 240/81 BS |
| 2,079,532 | 5/1937 | Sheppard | 240/81 BS |
| 2,902,592 | 9/1959 | Cole et al. | 240/81 R |
| 3,014,087 | 12/1961 | Kaplan | 174/69 |
| 3,038,021 | 6/1962 | Larson | 174/69 |
| 3,694,647 | 9/1972 | Chapman et al. | 240/81 R |

*Primary Examiner*—L. T. Hix
*Assistant Examiner*—Alan Mathews
*Attorney, Agent, or Firm*—Morse, Altman, Oates & Bello

[57] ABSTRACT

In a floor lamp having, as a stand, upper and lower telescoping rigid tubes extending between a supporting base and a supported lamp socket, an electrical cord extends from the base to the socket through a spring-like plastic sleeve, which has an upper portion that is fixed to the upper tube, a medial portion that is extended linearly through the lower sleeve and a lower portion that is coiled compactly in the base. Reciprocation of the upper tube in the lower tube in order to adjust the height of the socket causes more or less of the plastic sleeve to be stored in its lower coiled portion while preventing fouling of the electrical cord as a result of frequent raising and lowering of the stand.

7 Claims, 3 Drawing Figures

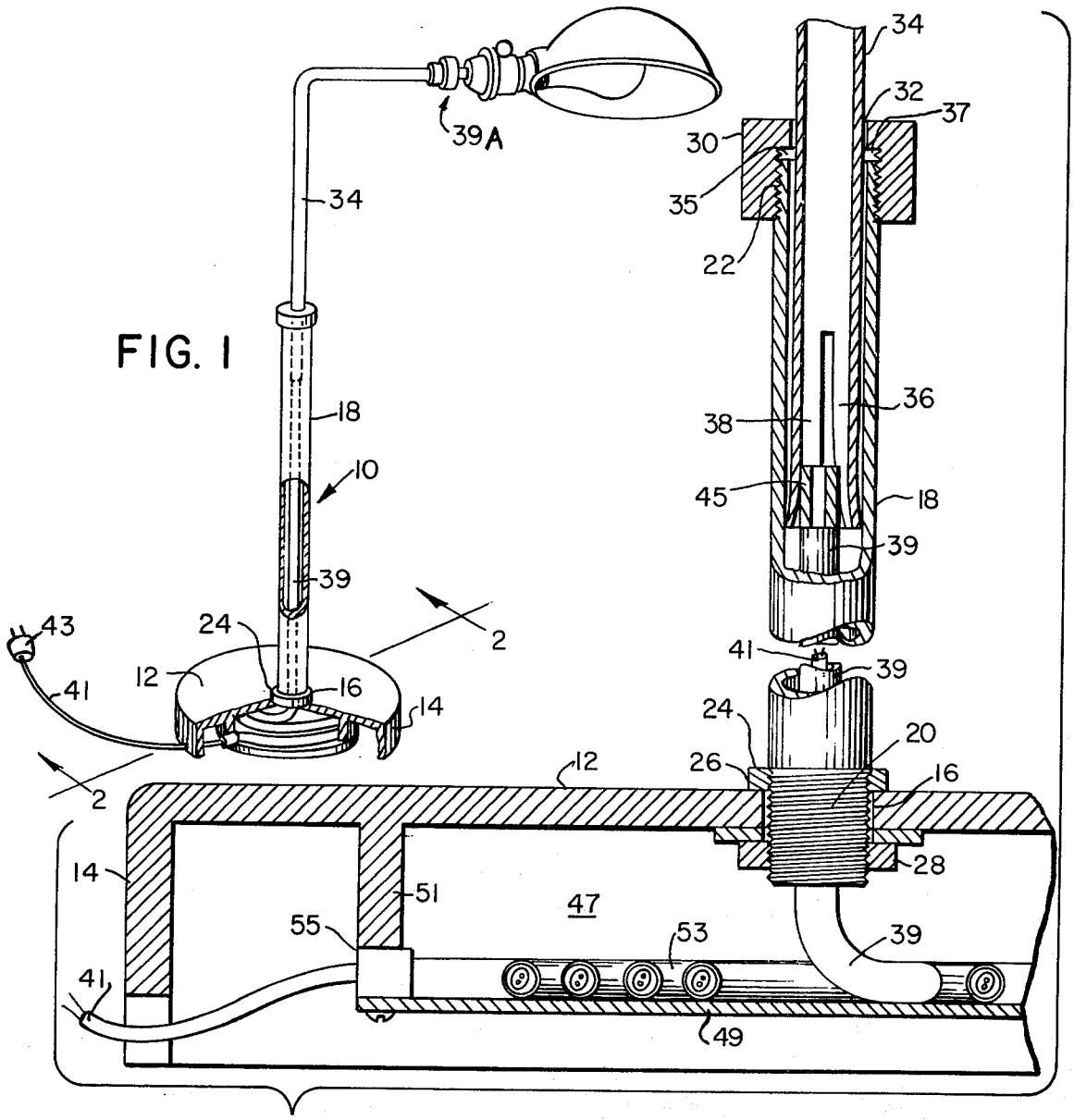
FIG. 1
FIG. 2
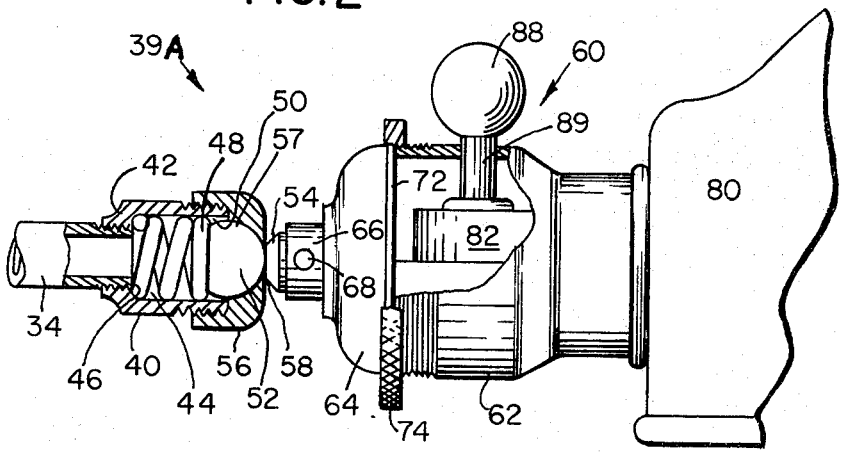
FIG. 3

MULTIPLE POSITION LAMP

BACKGROUND OF THE INVENTION

1. Field of the Invention

The present invention relates to lamps and, more particularly, to multiple position lamps characterized by a lamp socket carried by an extensible and retractible stand.

2. Description of the Prior Art

In a floor lamp or the like having, as a stand, extensible and retractible telescoping tubes, repeated extending and retracting of the stand often results in fouling, i.e. knotting, twisting or breaking, the electrical cord that extends from the base of the lamp through the stand to a lamp socket at the top of the stand.

SUMMARY OF THE INVENTION

The primary object of the present invention is to provide in a floor lamp or the like having, as a stand, upper and lower telescoping rigid tubes extending between a supporting base and a supported lamp socket, a springlike plastic sleeve, which has an upper portion that is fixed to the upper tube, a medial portion that is extended linearly through the lower sleeve and a lower portion that is coiled compactly in the base. Reciprocation of the upper tube in the lower tube in order to adjust the height of the socket causes more or less of the plastic sleeve to be stored in its lower coiled portion while preventing fouling of the electrical cord as a result of frequent raising and lowering of the stand. The construction and composition of certain of the operating components are pertinent to the results achieved.

Other objects of the present invention will in part be obvious and will in part appear hereinafter.

The invention accordingly comprises the lamp possessing the construction, combination and composition of elements and arrangement of parts, which are exemplified in the following detailed description, the scope of which will be indicated in the appended claims.

BRIEF DESCRIPTION OF THE DRAWINGS

For a fuller understanding of the nature and objects of the present invention, reference is made to the following detailed description, taken in connection with the accompanying drawings, wherein:

FIG. 1 is a perspective view of a lamp embodying the present invention;

FIG. 2 is a sectional, broken away view of FIG. 1, taken substantially along the lines 2—2; and FIG. 3 is a fragmentary, broken away view of a part of the lamp of FIG. 1.

DETAILED DESCRIPTION OF THE PREFERRED EMBODIMENT

Referring now to the drawings, a multiple position, variable intensity lamp embodying the invention is shown in FIG. 1 at 10. Lamp 10 comprises a circular base portion 12 which is provided with an annular skirt 14. Base portion 12 is formed with a concentric through hole 16 which is adapted to receive a sleeve 18 having externally threaded ends 20, 22. An internally threaded ring 24 having a knurled outer edge 26 and a fastener 28, for example a hexagon nut, are turned onto threaded end 20 at the opposed faces of base portion 12. Hole 16 is slightly larger than threaded end 20 and smaller than ring 24 and nut 28, in order to clamp sleeve 18 in position with respect to base portion 12.

An internally threaded bushing 30 is turned onto threaded end 22. Bushing 30 is provided with a concentric through hole 32 which is adapted to slidably receive a hollow elbow shaft 34. A fabric washer 35 is interposed between upper end of sleeve 18 and a shoulder 37 at the interior face of bushing 30.

As best shown in FIG. 2, one end of shaft 34 is bifurcated and defines a pair of substantially equal and outwardly divergent arcuate legs 36, 38, which operate to engage the interior wall of sleeve 18. The engagement of legs 36, 38 and the interior wall of sleeve 18 defines a frictional lock, i.e. shaft 34 is slidable and rotatable within sleeve 18 upon application of a force sufficient to overcome the friction between legs 36, 38 and the interior wall of sleeve 18. The outer end of shaft 34 is externally threaded to receive a lamp socket and shade fixture 60 as described below.

Extending between upper reciprocable shaft 34 and base portion 12 through lower stationary tube 18 is a springy plastic tube 39, which serves as a conduit for a double wire electrical cord 41. The lower extremity of cord 41 is terminated by a double contact, electrical plug 43. The upper extremity of cord 41 is terminated by socket fixture 60. As shown, the upper extremity of plastic tube 39 is adhered to a hollow neck 45 which is welded to leg 38 of upper tube 34. Plastic tube 39 extends from the lower extremity of upper shaft 34 through lower shaft 18, to a compartment 47 in base portion 12, where it assumes a coiled configuration 53. Compartment 47 is defined by the horizontal upper portion of base 12 and by a lower plate 49, which is secured to a circular web 51 above the lower periphery of depending rim 14. From coiled configuration 53, plastic tube 39 extends through a conduit 55 in web 51, to which it is anchored, and outwardly through a conduit in rim 14 to plug 43.

The polymer of which plastic tube 39 is composed, is semi-rigid, i.e. can be coiled into loops of small diameter without exceeding its elastic limits. Preferably this polymer is a linear polyamide i.e. nylon, formed by condensation of dibasic acids and diamines to form linear chains containing amide linkages. Preferred polymers have a tensile strength ranging from 7,000 to 20,000 p.s.i, and elongation ranging from 6.5 to 320 percent, a modulus of elasticity in tension ranging from $1.5 \times 10^5$ to $4.0 \times 10^5$ p.s.i., a compressive strength ranging from 6,700 to 13,000 p.s.i., and a flexural strength ranging from 3,500 to 13,800 p.s.i. The method of preparing the coil is as follows. The tube, which preferably has an outside diameter of from ⅛ to 1 inch and a wall thickness of from 0.010 to 0.400 inch, first is wrapped about a mandril of a size sufficient to determine the selected diameter. Next steam is passed through the tube in order to heat the tube beyond its softening point (thorough heating of the tube in this manner causes its elastic limit to be exceeded). Finally cold water is passed through the tube in order to reduce its temperature to below the softening point and to harden the tube in semi-rigid helical form.

Referring now to FIG. 3, it will be seen that fixture 60 includes a socket 40 and a cap 56. Socket 40 is provided with an internally threaded tapered end section 42 which is turned onto the externally threaded end of shaft 34. The opposite end of socket 40 is externally threaded and is formed with a spherical chamber 44. One end of chamber 44 is opened and the other end is formed with an annular shoulder 46. A resilient member 48, for example a helical tension spring, rests on shoulder 46 and extends axially into chamber 44. A seat 50 is interposed between spring 48 and a ball 52, which has an extending shaft 54. Cap 56 is internally threaded and is formed with a seat portion 57 having a concentric through hole 58. Cap 56 is turned onto the externally threaded section of socket 40. In consequence, seat 50 is urged against ball 52, ball 52 is pressed into seat portion 57, and shaft 54 extends through hole 58. It will be appreciated that ball 52 is universally pivoted within seat 50 and socket 57. The free end of shaft 54 is attached to a lamp receptacle 60. From the foregoing description, it will be apparent that lamp 10 provides a relatively unlimited degree of adjustment, i.e. shaft 34 is rotatable and slidable within sleeve 18 and receptacle 60 is universally pivoted with respect to shaft 34.

Lamp receptacle 60 includes a forward section 62 and a rearward section 64. Rearward section 64 is formed with an annular flange 66 which is adapted to receive shaft 54. A fastener 68, for example a set screw, is turned into a threaded hole in flange 66 and engages shaft 54, whereby shaft 54 is secured within flange 66. The forward end of rearward section 64 is provided with an annular rib 72 and the rearward end of forward section 62 is externally threaded. An internally threaded ring 74 having a rearward annular shoulder portion adapted to engage rib 72 is turned onto the externally threaded rearward end of forward section 62. In consequence, forward section 62 and rearward section 64 are fastened together by ring 74. The forward end of forward section 62 is externally threaded and is adapted to receive an internally threaded flange 78 of a dome shaped shade 80. Mounted within forward section 62 is a variable intensity control 82, which includes a variable impedance, for example, a potentiometer having a wiper arm which is operatively connected to a control knob 88 via an insulating rod 89. Knob 88 is connected also to the contact arm of a switch. As indicated above, power cord 41 is threaded through annular guide 108 and plastic tube 39.

Operation

In operation, the height of lamp and socket 39A is adjusted repeatedly as desired by manually raising or lowering shaft 34 under the fractional control of legs 36, 38. When shaft 34 is lowered, the medial portion of plastic tube 34 is stored as incremental loop or portions thereof in coil 39 within chamber 47. When shaft 34 is raised, the medial portion of plastic tube 34, in the form of incremental loops or portions thereof, is withdrawn from coil 39 within chamber 47. The action of plastic tube 34 prevents fouling of electrical cord 41 while permitting great versatility in the orientation of lamp 39.

Since certain changes may be made in the present disclosure without departing from the scope of the invention herein involved, it is intended that all matter contained in the foregoing description or shown in the accompanying drawings be interpreted in an illustrative and not in a limiting sense.

What is claimed is:

1. A lamp comprising a base having a horizontal base portion and a depending skirt portion, a plate mounted in said base under said horizontal base portion and defining a base chamber therewith, said horizontal base portion having an opening therethrough, a lower rigid tube affixed to said base portion and communicating with said opening, an upper rigid tube slidable frictionally and telescopically in said lower rigid tube, a lamp socket connected to the upper end of said upper rigid tube, a semi-rigid spring-like tube having an upper linear portion connected fixedly to said upper rigid tube and extending downwardly through said lower rigid tube into said base chamber, said semi-rigid springlike tube having a lower coiled portion in said base chamber, an electrical cord having one end electrically and mechanically connected with said socket, extending through said semi-rigid spring-like tube and extending outwardly from within said base chamber, an electrical plug being electrically connected to the other end of said electrical cord, selected increments of said semi-rigid spring-like tube being part of said lower coiled portion when said upper rigid tube is retracted to a first position toward said base and being part of said upper linear portion when said upper rigid tube is extended to a second position away from said base, said semi-rigid spring-like tube having a predetermined elastic limit, said selected increments at no time exceeding said predetermined elastic limit, whereby when said upper tube is telescopically extended a lesser portion of said electrical cord is stored in said coil and when said upper tube is telescopically retracted a greater portion of said electrical cord is stored in said coil.

2. The lamp of claim 1 wherein said lamp socket is universally pivotable with respect to said upper rigid tube.

3. The lamp of claim 1 wherein a portion of said semi-rigid spring-like tube is fixed to said base.

4. The lamp of claim 1 wherein said semi-rigid spring-like tube is composed of plastic.

5. The lamp of claim 1 wherein said semi-rigid spring-like tube is composed of a linear polyamide.

6. A lamp comprising a base having a horizontal base portion and a depending skirt portion, a plate mounted in said base under said horizontal base portion and defining a base chamber therewith, said horizontal base portion having an opening therethrough, a lower rigid tube affixed to said base portion and communicating with said opening, an upper rigid tube slidable frictionally and telescopically in said lower rigid tube, a lamp socket connected to the upper end of said upper rigid tube, a semi-rigid spring-like tube having an upper linear portion connected fixedly to said upper rigid tube and extending downwardly through said lower rigid tube into said base chamber, said-rigid springlike tube having a lower coiled portion in said base chamber, an electrical cord having one end electrically and mechanically connected with said socket, extending through said semi-rigid spring-like tube and extending outwardly from within said base chamber, an electrical plug being electrically connected to the other end of said electrical cord, selected increments of said semi-rigid spring-like tube being part of said lower coiled portion when said upper rigid tube is retracted to a first position toward said base and being part of said upper linear portion when said upper rigid tube is extended to a second position away from said base, said semi-rigid spring-like tube having an elastic limit, said selected increments at no time exceeding said elastic limit, whereby when said upper tube is telescopically extended a lesser portion of said electrical cord is stored in said coil, and when said upper tube is telescopically retracted a greater portion of said electrical cord is stored in said coil, said lamp socket being universally pivotable with respect to said upper rigid tube, a portion of said semi-rigid spring-like tube being fixed to said base, said semi-rigid spring-like tube being composed of plastic.

7. The lamp of claim 6 wherein said semi-rigid spring-like tube is composed of a linear polyamide having a tensile strength ranging from 7,000 to 20,000 p.s.i., an elongation ranging from 6.5 to 320 percent, a modulus of elasticity in tension ranging from $1.5 \times 10^5$ to $4.0 \times 10^5$ p.s.i., a compressive strength ranging from 6,700 to 13,000 p.s.i., and a flexural strength ranging from 3,500 to 13,800 p.s.i.

* * * * *